US006261413B1

(12) United States Patent
Hepp

(10) Patent No.: US 6,261,413 B1
(45) Date of Patent: Jul. 17, 2001

(54) CONTINUOUSLY GUIDING LIQUIDS IN A DIGESTER DURING PULP DIGESTION

(75) Inventor: Manfred Dietmar Hepp, Wels (AT)

(73) Assignee: Impco-Voest-Alpine Pulping Technologies GmbH, Linz (AT)

( * ) Notice: Subject to any disclaimer, the term of this patent is extended or adjusted under 35 U.S.C. 154(b) by 0 days.

(21) Appl. No.: 08/832,770

(22) Filed: Apr. 3, 1997

(30) Foreign Application Priority Data

Apr. 4, 1996 (AT) ..... 612/96

(51) Int. Cl.[7] ..... D21C 3/26

(52) U.S. Cl. ..... 162/19; 162/38; 162/42; 162/45

(58) Field of Search ..... 162/19, 38, 37, 162/42, 39, 40, 45, 52, 248, 29

(56) References Cited

U.S. PATENT DOCUMENTS

| | | | | |
|---|---|---|---|---|
| Re. 20,266 | * | 2/1937 | Dunbar et al. | 92/7 |
| 2,091,513 | * | 8/1937 | Merrill | 92/11 |
| 3,752,319 | | 8/1973 | Richter | 210/357 |
| 4,571,282 | * | 2/1986 | Almond et al. | 162/47 |
| 4,670,098 | * | 6/1987 | Thorsell et al. | 162/29 |
| 4,693,785 | | 9/1987 | Laakso | 162/242 |
| 4,849,052 | | 7/1989 | Grant | 162/39 |
| 5,522,958 | * | 6/1996 | Li | 162/19 |
| 5,547,012 | * | 8/1996 | Marcoccia et al. | 162/42 |
| 5,958,183 | * | 9/1999 | Graf et al. | 162/47 |

FOREIGN PATENT DOCUMENTS

| | | |
|---|---|---|
| 0 100 293 | 2/1984 | (EP) . |
| WO 91/05103 | 4/1991 | (WO) . |

OTHER PUBLICATIONS

McDonald, Ronald, "The Pulping of Wood", 2nd Edition, vol. 1, pp. 407–427, 1969.*

* cited by examiner

*Primary Examiner*—Dean T. Nguyen
(74) *Attorney, Agent, or Firm*—Oblon, Spivak, McClelland, Maier & Neustadt, P.C.

(57) ABSTRACT

The present invention relates to a process for continuously guiding a liquid when digesting pulp in a digester, wherein liquid used in a process step can circulate between containers or tanks arranged at the inflow and outflow side of the digester and when this particular process step has been reached, the digester is connected into the circulation between the containers or tanks associated with the process step.

7 Claims, 10 Drawing Sheets

COMPARE TESTS: ENERBATCH-RDH-CBC

| TYPE | PK NUMBER | BASKET KAPPA | BASKET YIELD % | BASKET VISCOSITY $cm^3/g$ | BLOWTANK KAPPA | BLOWTANK VISCOSITY $cm^3/g$ | FILTER KAPPA | FILTER VISCOSITY $cm^3/g$ | BLOWTANK KAPPA | BLOWTANK TENSILE Nm/g | BLOWTANK TEAR mN | AFTER I. FILL EA g/l | AFTER I. FILL TENSILE g/l | BEG. COOK EA g/l | BEG. COOK Na25 g/l | END COOK EA g/l | END COOK Na25 g/l | END COOK H-FACTOR | END COOK C TEMP °C | TTT+TAT min | CYCLE TIME min | ALKALI AA TO DIG. % | ALKALI AA INCL. TANKS % | AA TO EVAP. % | AA CONSUMED % |
|---|---|---|---|---|---|---|---|---|---|---|---|---|---|---|---|---|---|---|---|---|---|---|---|---|---|
| ENERBATCH | 401 | 16.9 | 42.0 | 786 | 15.1 | 812 | 14.6 | 806 | 15.1 | 88.6 | 12.2 | 24.9 | 14.0 | 19.4 | 15.7 | 14.7 | 13.0 | 2600 | 170 | 157 | 250 | 28.0 | 29.1 | 6.4 | 22.7 |
| ENERBATCH | 402 | 17 | 42.7 | 765 | 15.6 | 795 | 15.3 | 764 | 15.6 | 96.4 | 11.5 | 24.9 | 15.6 | 18.6 | 11.5 | 14.5 | 13.4 | 2600 | 170 | 157 | 248 | 28.0 | 29.6 | 5.2 | 24.4 |
| ENERBATCH | 403 | 16.1 | 42.5 | 801 | 15.3 | 801 | 15.5 | 808 | 16.3 | 96.1 | 10.9 | 25.3 | 14.1 | 16.5 | 13.0 | 12.4 | 14.2 | 2800 | 170 | 169 | 262 | 28.0 | 28.7 | 5.1 | 23.8 |
| RDH | 404 | 18.8 | 41.9 | 773 | 16.8 | 785 | 17.8 | 784 | | | | 6.2 | 7.4 | 37.6 | 21.0 | 28.8 | 20.2 | 1500 | 170 | 115 | 231 | 31.7 | 25.7 | 3.4 | 22.3 |
| RDH | 405 | 19.5 | 41.8 | 802 | 15.9 | 838 | 19.1 | 802 | | | | 5.5 | 9.0 | 30.9 | 17.1 | 20.3 | 18.9 | 1700 | 170 | 126 | 231 | 27.2 | 31.2 | 2.7 | 28.5 |
| RDH | 406 | 17.8 | 41.6 | 771 | 15.6 | 807 | 17.4 | 804 | 16.8 | 97.5 | 11.7 | 9.2 | 9.6 | 30.9 | 18.6 | 18.9 | 17.1 | 1900 | 170 | 140 | 243 | 27.2 | 25.7 | 4.6 | 21.1 |
| RDH | 407 | 18.1 | 41.7 | 838 | 18.4 | 885 | 18.2 | 858 | 17.0 | 95.2 | 11.5 | 4.7 | 7.7 | 18.9 | 14.0 | 13.6 | 12.2 | 2520 | 170 | 173 | | 27.2 | | 2.4 | |
| RDH | 408 | 18.3 | 41.4 | 796 | 17.3 | 802 | 18.5 | 818 | 16.4 | 89.2 | 12.7 | 11.5 | 9.2 | 27.0 | 17.1 | 17.1 | 16.4 | 2050 | 170 | 149 | 256 | | | 6.1 | |
| CONT.BATCH | 415 | 15.5 | 41.9 | 881 | 17.4 | 858 | 20.0 | 893 | | | | 19.8 | 14.0 | 8.3 | 14.5 | 16.2 | 15.0 | 2000 | 170 | 109 | 211 | 42.9 | 32.1 | 8.0 | 24.1 |
| CONT.BATCH | 416 | 16.5 | 41.7 | 830 | 17.5 | 921 | 19.7 | 905 | 17.5 | 93.2 | 12.7 | 22.6 | 14.3 | 8.7 | 13.8 | 16.9 | 14.3 | 2000 | 170 | 110 | 217 | 28.6 | 25.6 | 6.8 | 18.8 |
| CONT.BATCH | 417 | 14.1 | 41.1 | 825 | 17.3 | 816 | 17.6 | 816 | 18.5 | 92.4 | 13.5 | 8.5 | 5.4 | 18.6 | 15.0 | 28.8 | 18.9 | 1500 | 170 | 89 | 196 | 43.6 | 25.2 | ### | 12.8 |
| CONT.BATCH | 418 | 13.9 | 40.9 | 811 | 15.8 | 826 | 15.6 | 838 | 17.1 | 93.4 | 12.4 | 20.7 | 13.8 | 7.6 | 7.0 | 16.8 | | 2600 | 170 | 153 | 261 | 27.1 | 30.1 | 7.5 | 22.6 |
| CONT.BATCH | 419 | 20.8 | 43.1 | 980 | 21.0 | 939 | 20.4 | 950 | 22.4 | 91.6 | 12.5 | 21.0 | 12.0 | 7.6 | 6.9 | 16.5 | | 2000 | 170 | 119 | 236 | 25.3 | 22.2 | 7.9 | 14.3 |

*FIG. 2*

CONTINUOUSLY GUIDING LIQUIDS IN A DIGESTER DURING PULP DIGESTION

BACKGROUND OF THE INVENTION

1. Field of the Invention

The present invention relates to a process for continuously guiding liquids when digesting pulp in a digester.

2. Discussion of the Background

In a modern pulp digestion process, several steps are required, thus, among others, an impregnation under particular process conditions, e.g. at a low temperature, and digestion under different conditions, e.g. at a higher temperature, as well as, if desired, one or several washing steps, which are effected by using hot and/or cold washing liquid or washing filtrate, respectively. For the production of pulp, the solvents used in the individual process steps for the dissolving out of certain components must have certain properties, such as, e.g., the type of solvent, whether aqueous or organic, concentrations of acids, alkali and salts, temperatures, etc.

For reasons of costs and last but not least for environmental reasons it is desirable to keep the amount of chemicals and the liquid required in the individual steps as low as possible and to re-use the solvents utilized to the greatest possible extent.

According to WO 91/05103, preconditioned wood chips are preheated in a first chamber by means of circulating black liquor at a low temperature and are continuously fed into a second chamber at high pressure and temperature. In the second chamber, the wood chips are advanced to a cooking temperature by circulating hot black liquor, whereupon they are transferred into the digester together with white liquor.

U.S. Pat. No. 4,693,785 relates to a digester for continuous processing. Supply and discharge of the liquors used are effected via a plurality of annular screen systems.

In U.S. Pat. No. 3,752,319, a strainer for separating liquid from a wood chips-liquid-mixture is described.

SUMMARY OF THE INVENTION

It is the object of the present invention to utilize in a process of the initially defined kind the structural equipment already present and to carry out the digesting procedure as economically as possible, with a minimum of newly added chemicals and fresh water.

According to the invention, this object is achieved in that liquid used in a particular process step can circulate between containers or tanks arranged at the inflow and outflow side of the digester and when this particular process step has been reached, the digester is connected into the circulation between the containers or tanks associated with this particular process step. To carry out the present invention, one pair of containers or tanks is assigned to each desired process step; e.g., to impregnation using an impregnating liquor (IL) an IL1 and an IL2 tank, to digestion using a cooking liquor (CL) a CL1 and a CL2 tank. The respective solvent used in that process step is then continuously circulated between the respective associated tanks 1 and 2 (or 2 and 1, respectively). In other words, this corresponds to an internal tank-to-tank circulation. If now, for instance, the solvent present in a tank 1 is needed in a process step in a pulp cooking device (digester), this digester is simply connected into the circulation from tank 1 to tank 2. Thus, solvent is provided in the respective tank 1 for direct use in this process step, and in tank 2 the spent solvent arriving from the process step is collected. It is also possible that the first container or tank arranged at the inflow side is formed by piping between the second container or tank and the digester. In this case the continuous feeding of chemicals takes place directly into the piping leading into the digester, the liquid flowing in the piping providing a sufficient mixing.

According to a preferred embodiment of the present invention, the used liquid is continuously discharged from the container or tank arranged at the outflow side of the digester and, by means of continuously added doses of chemicals and subsequent continuous temperature adjustment by means of heat exchangers, its original properties are restored, and it is recycled in circulation into the container or tank arranged at the inflow side of the digester. Thus, the demand for chemicals to be newly added can be kept low, since only the amount of chemicals actually spent must be replaced. Moreover, substantial amounts of energy can be saved, since merely an amount of energy corresponding to the thermal loss occurring in the digester has to be supplied. When the respective process step has been finished, the internal tank-to-tank circulation again becomes effective.

According to a preferred embodiment of the present invention a portion of the spent liquid is continuously branched off, at the outflow side, and continuously fed into a second circulation between containers or tanks arranged at the inflow and outflow side of the same and/or a different digester. Thereby it is possible to adjust the volume as well as the content of chemicals in the different circulation with minimal efforts and energy requirement.

Furthermore, it is preferable in the above mentioned case if the missing volume is replaced by continuously feeding fresh chemicals and/or washing solution and/or liquid from a different circulation. In this maimer a cascade-like connection of the different circulations provides for additional savings.

It is also advantageous if the second circulation is associated with the same particular process step as the first circulation. Only the amount of chemicals spent during the particular process step has to be added and the original temperature has to be restored before the liquid can be reused.

However, preferably the second circulation is associated with a different particular process step than the first circulation. In this case it is sometimes not even necessary to add chemicals or to heat the liquid.

Furthermore it is preferred it at the outflow side of the circulation(s) between the containers or tanks a portion of the spent liquid is continuously branched off and continuously fed into a chemical processing plant for the recovery of chemicals, the missing amount of volume being replaced in the container or tank by the addition of washing solution and/or excessive liquid from a different circulation. This prevents an excessive concentration of organic and inorganic components in the circulatory system.

With the present invention, inter alia the following objects are achieved:

- irrespective of the characteristics of the filling (such as, e.g., humidity, density, temperature) occurring in the respective process step, the contends of the digester (wood chips) are always subjected to constant solvent conditions;
- the solvent conditions can easily be adapted to new requirements;
- the energy content of the solvents is not created by heating up in a digester and storing in a tank after that process step, and instead the energy content of the solvents is created tank-internally (by tank-to-tank circulation) and is provided from the tank to the digester contents to heat up the same;

no circulation means whatsoever associated with the digester are required;

all the comsumption values are continuous;

a smaller tank volume is needed;

a shorter digestion period is required;

a uniform pulp quality is attained and can be altered easily; and a very simple and transparent management control for the modules of the tank farm, quality optimation, energy and sequence can be realized.

Moreover, it is possible with the process of the present invention to provide at the outflow side of the digester for a concentration profile of chemicals increasing with the reaction time. By this unique feature of the process according to the present invention it is possible to have uniform treatment of the content of the digester during the whole reaction time, whereas according to conventional processes the concentration profile of chemicals at the outflow side of the digester is always decreasing. Clearly a concentration profile increasing with the reaction time means that the pulp can be more uniformly treated, impregnated, cooked, etc, since at any time during the reaction a sufficient amount of chemicals is present. This advantage will be more clearly understood from the enclosed tables (FIGS. 2 to 10).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 shows a comparison between conventional processes (designated "ENERBATCH"™ and "RDH") and the process according to the present invention (designated "CBC").

DESCRIPTION OF THE PREFERRED EMBODIMENTS

Figure 1:
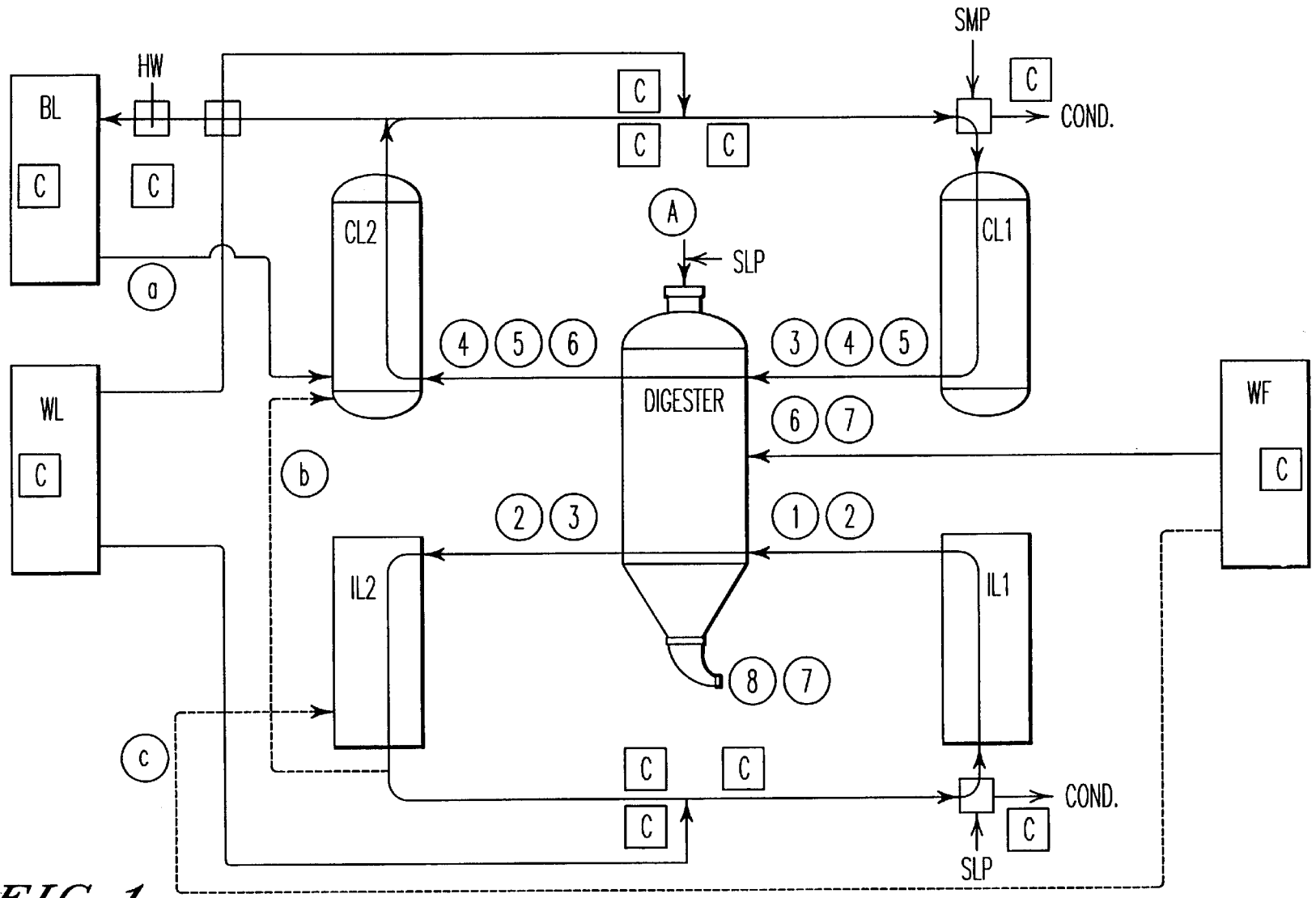
FIG. 1 illustrates the process outline for an example of kraft pulp digestion.
Figure 3:
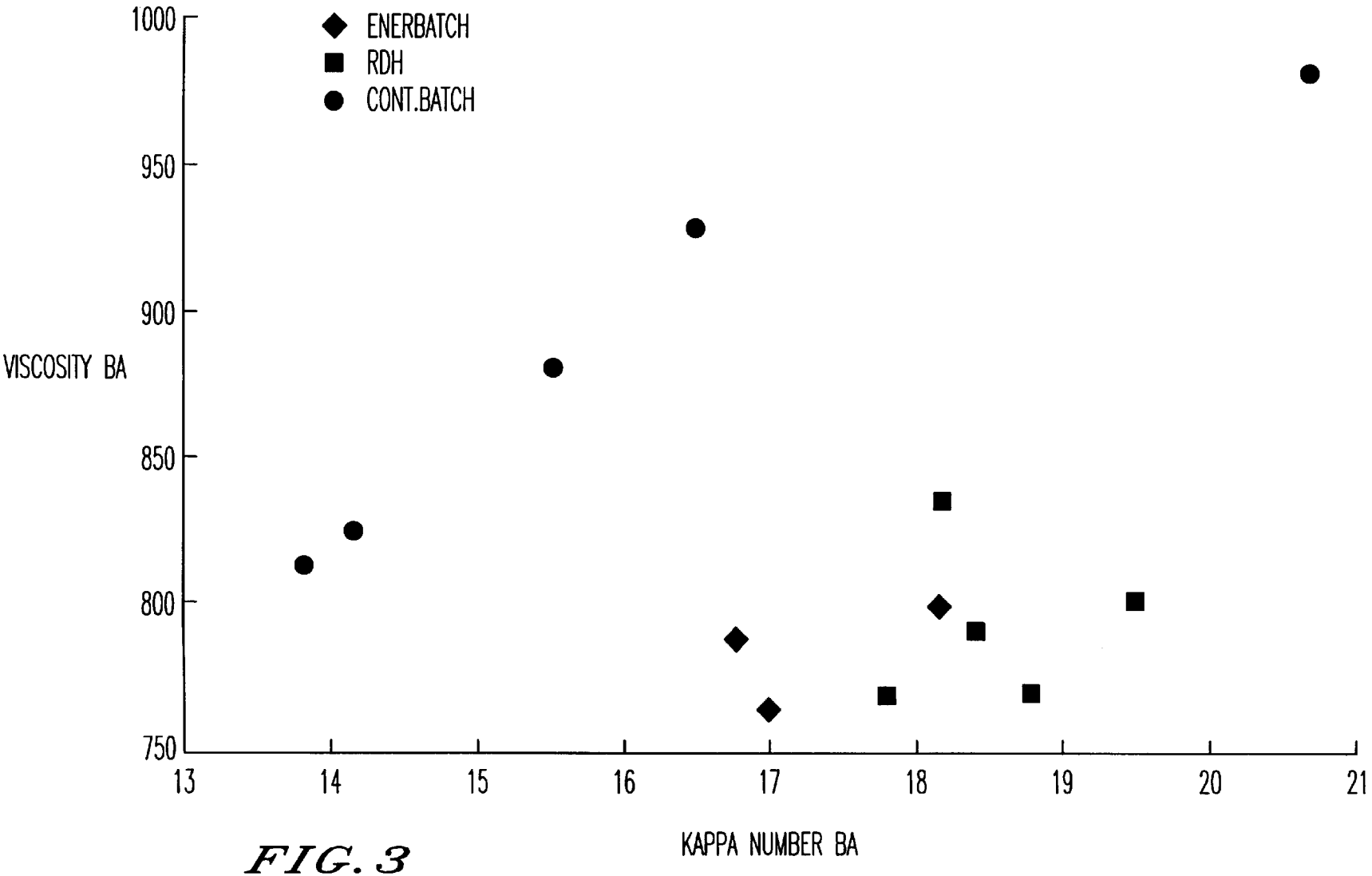
FIGS. 3 to 7 shows different parameters of pulp obtained by conventional processes (designated "ENERBATCH" and "RDH") and by the process according to the present invention (designated "CBC" i.e. continuous batch) are compared.
Figure 4:
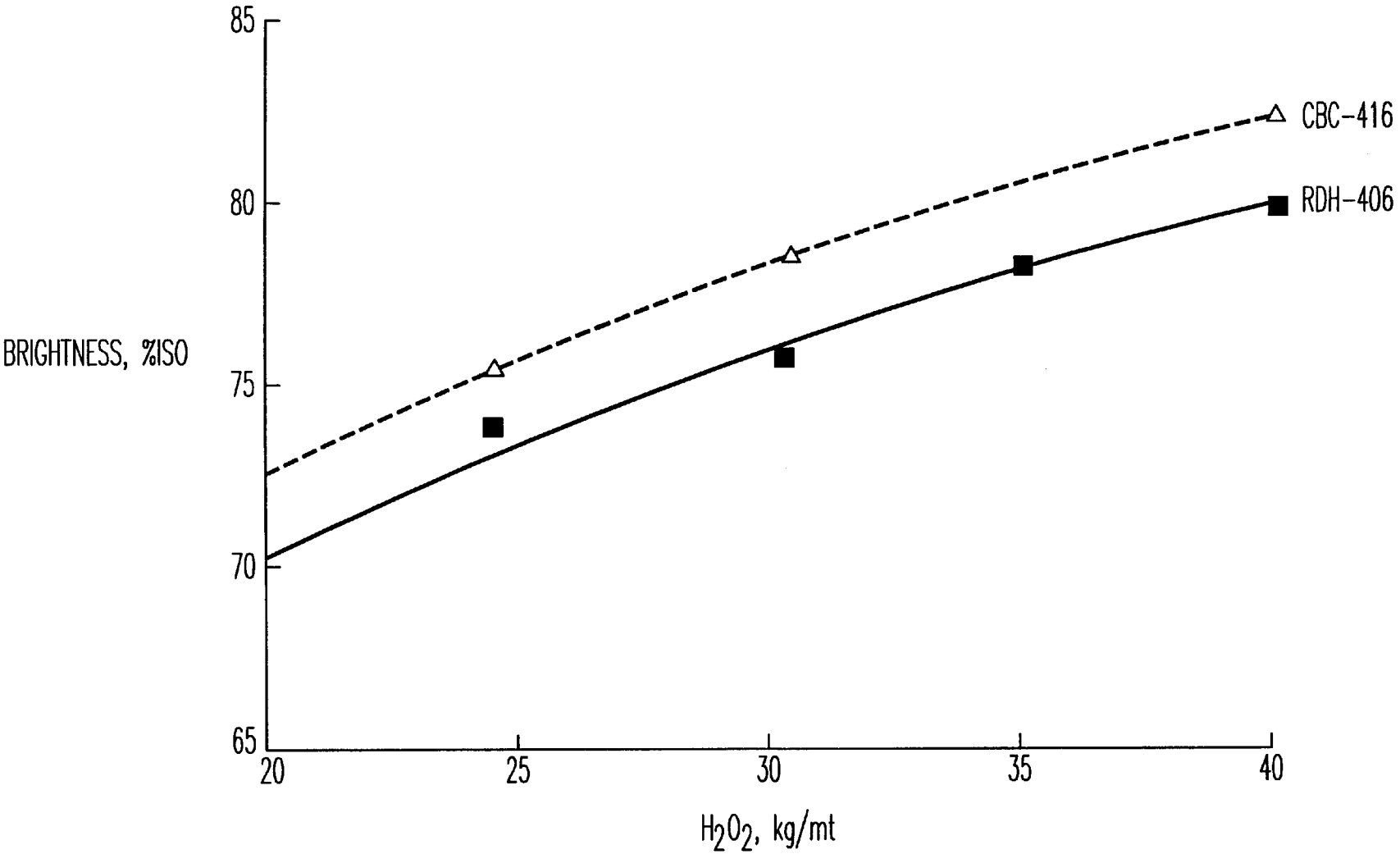
Figure 5:
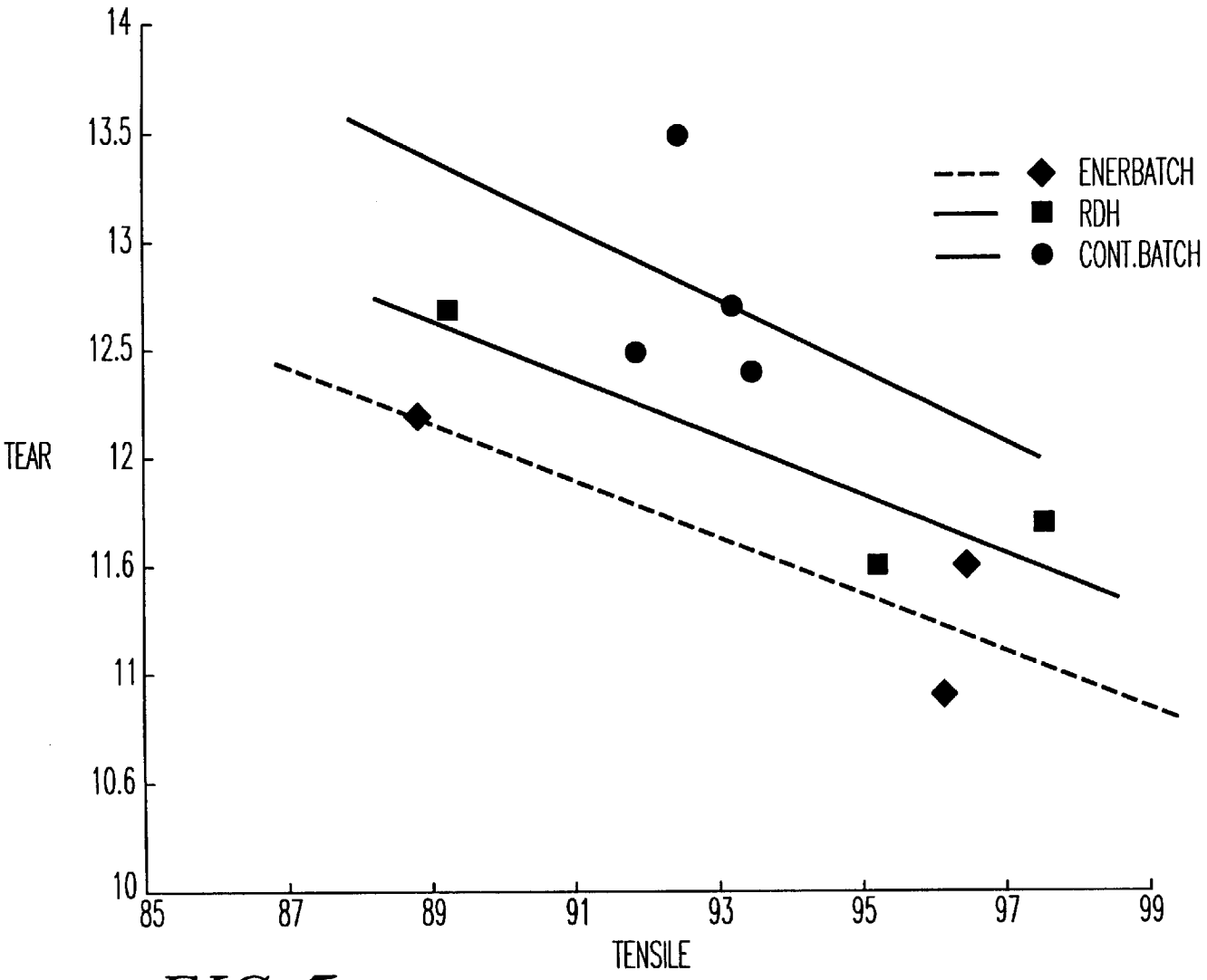
Figure 6:
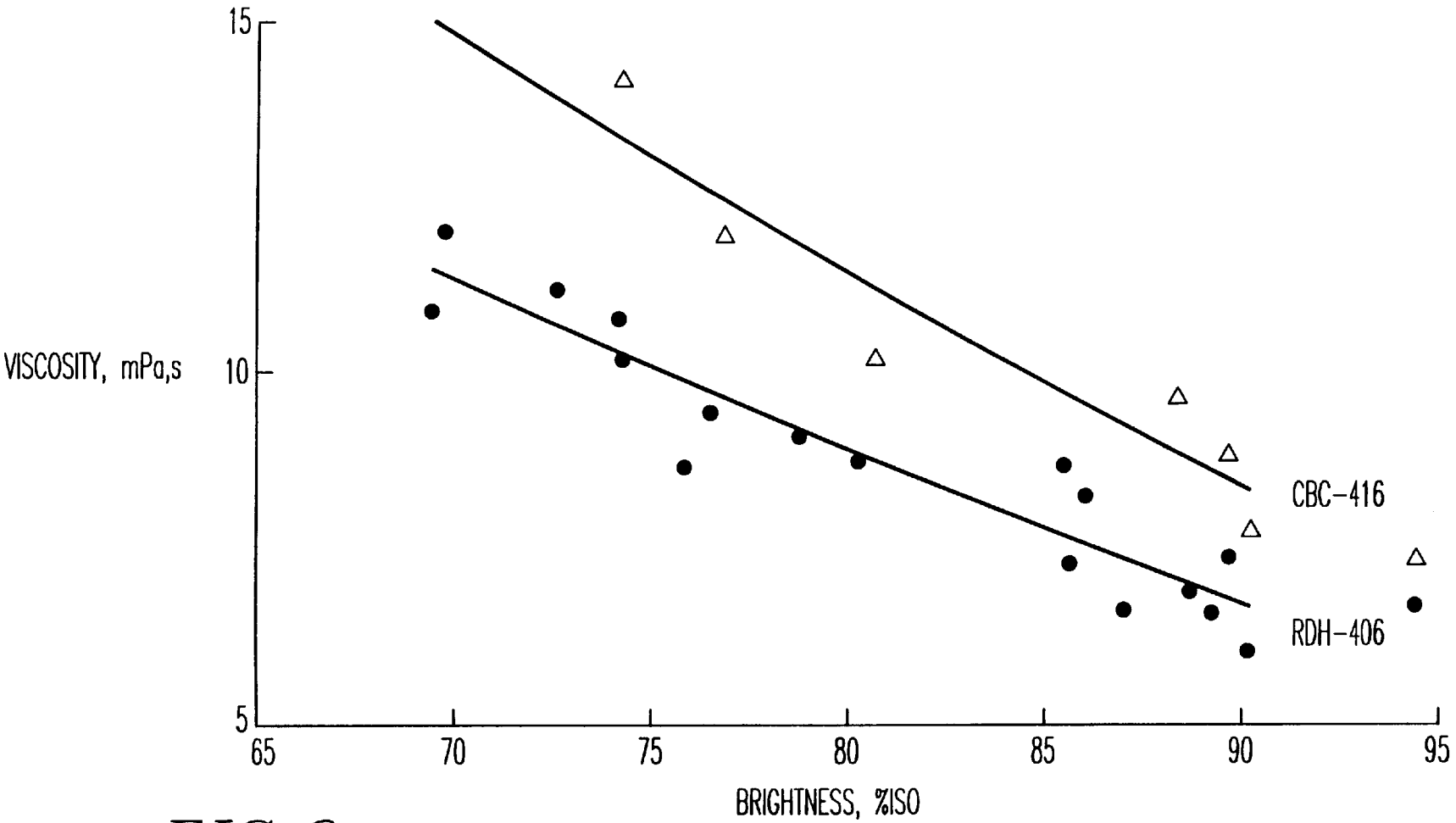
Figure 7:
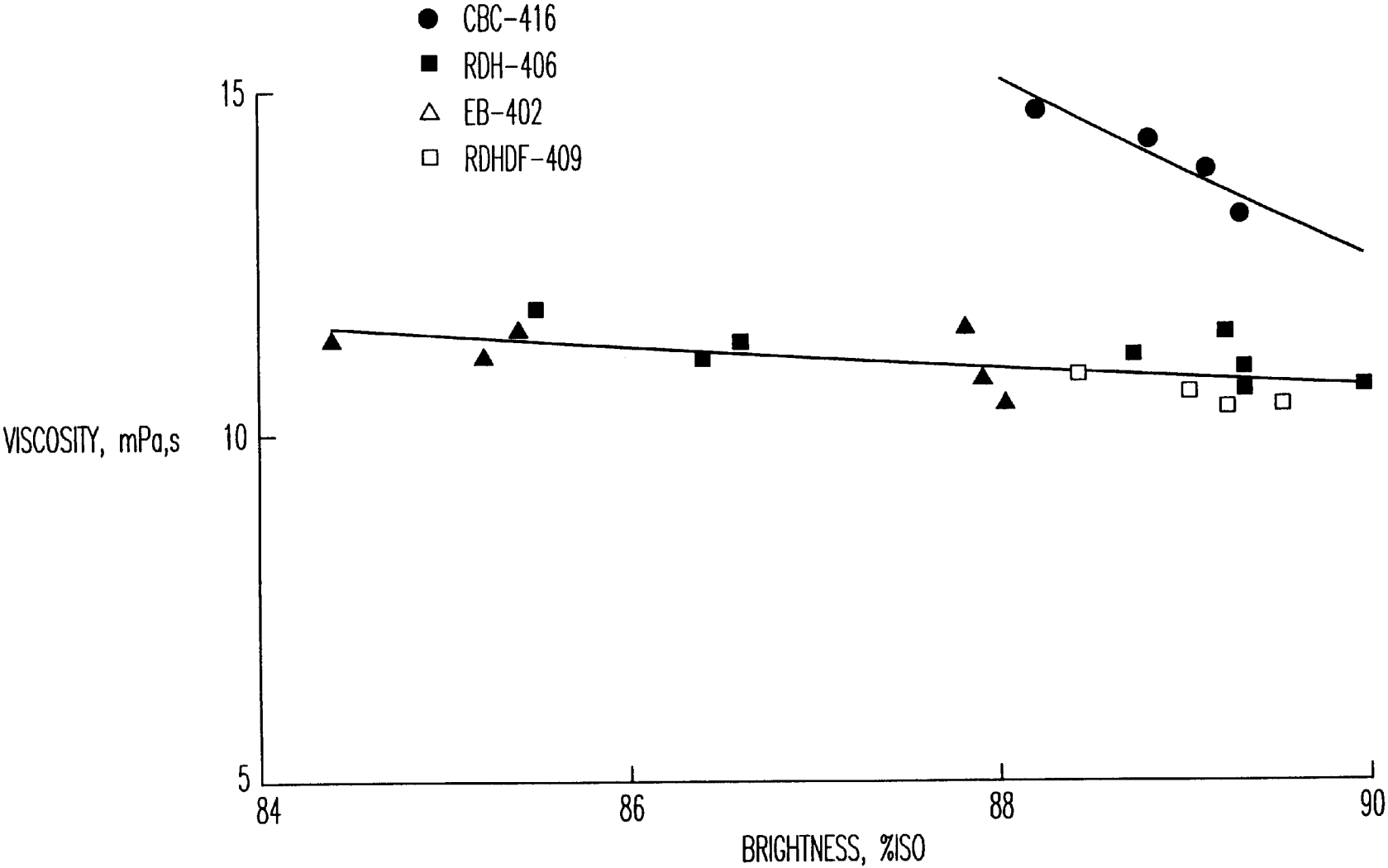
Figure 8:
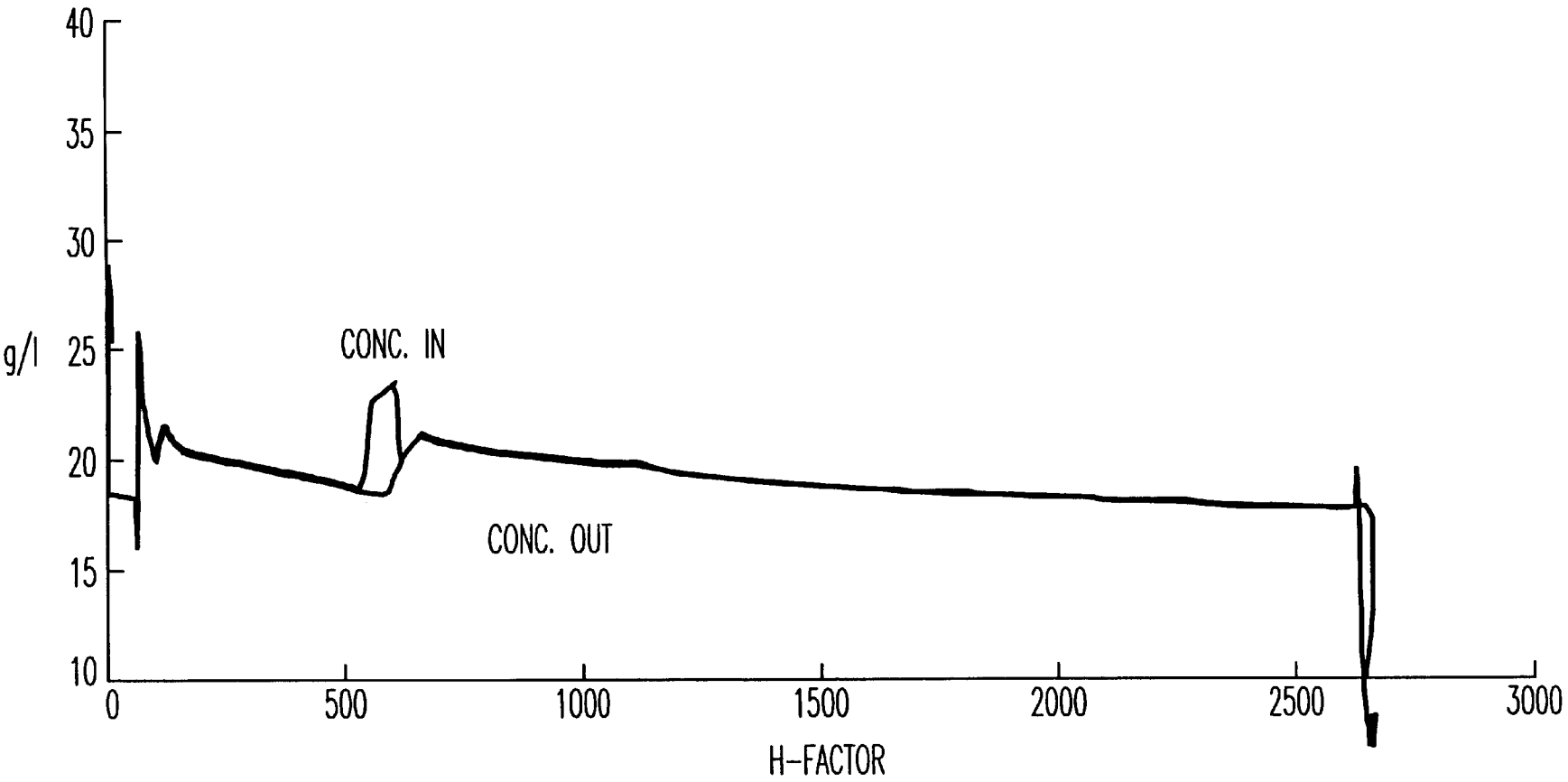
FIGS. 8 to 10 show the alkali profile as measured at the outflow side of the digester, again for conventional processes (FIG. 8 for "ENERBATCH" and FIG. 9 for "RDH") and for the process according to the present invention (FIG. 10 for "CBC").
Figure 9:
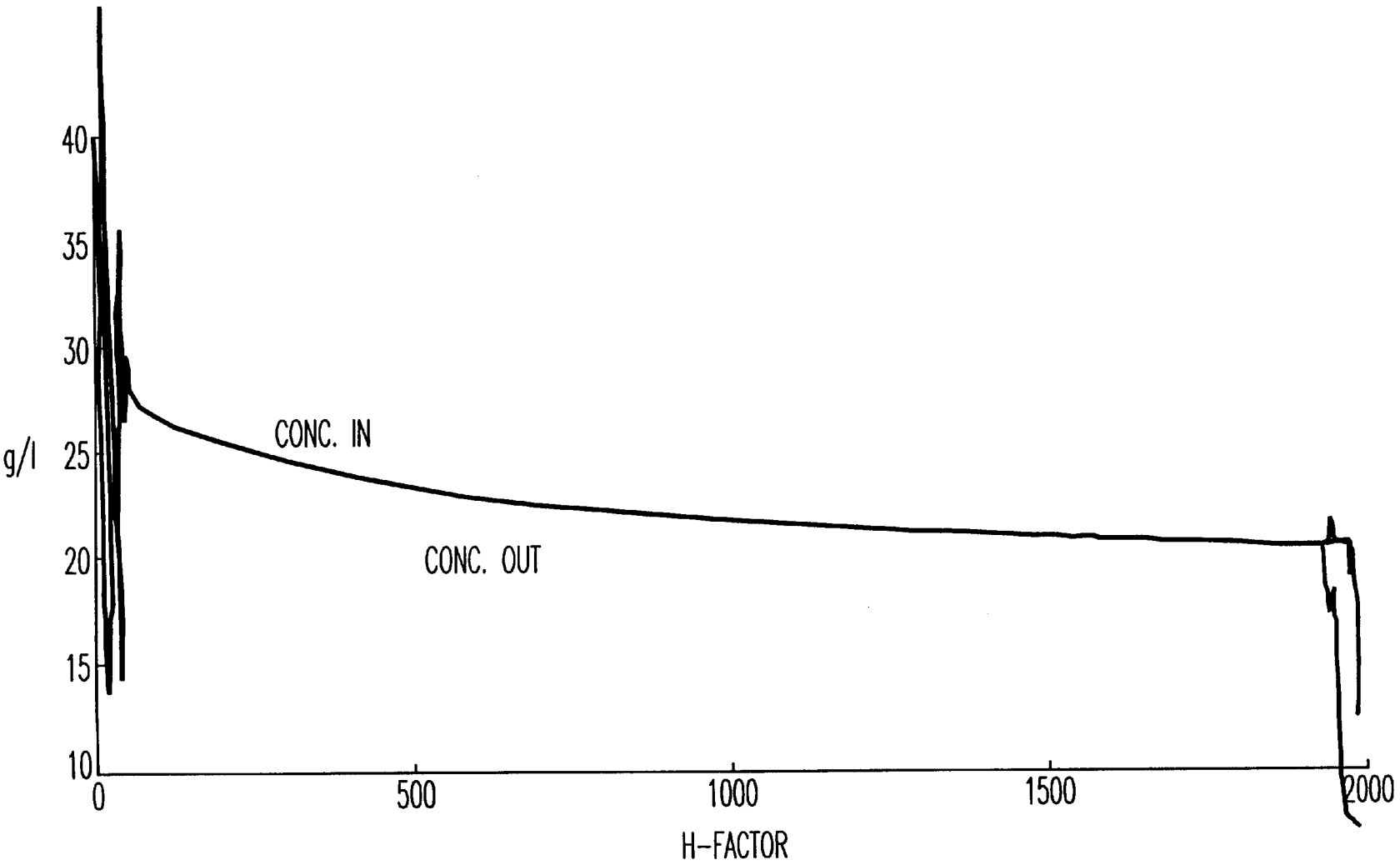
Figure 10:
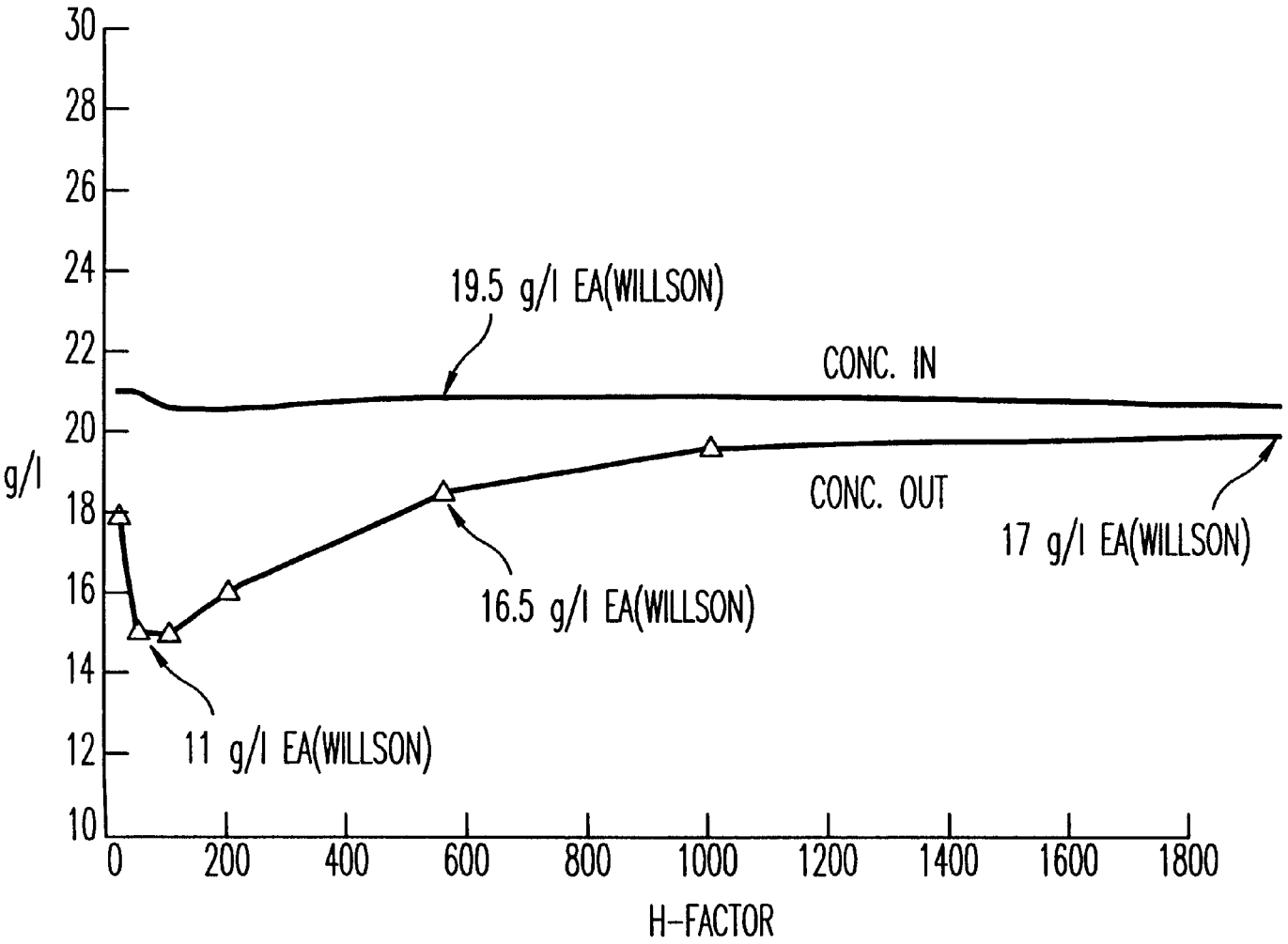

The invention will be explained in greater detail by the enclosed process outline for the example of a kraft pulp digestion (FIG. 1). The meaning of the Figure is as follows: Process Steps Which are Discontinuous: (indicated by circled reference numbers)

A.

1-Filling the wood chips into the digester (by means of low pressure vapor) and, possibly, simultaneously filling with impregnating liquor from tank IL1.

2-Filling the impregnating liquor from tank IL1, until the digester has reached an impregnating pressure.

3-Trans-displacement of the impregnating liquor from tank IL1 via the digester into tank IL2, while maintaining the impregnating pressure.

4-Hot-displacement of impregnating liquor by means of cooking liquor from tank CL1 via the digester into tank IL2, until tank IL2 has refilled the amount removed from IL circulation when filling with impregnating liquor.

5-Continuing the hot-displacement by means of cooking liquor from tank CL1 via the digester into tank CL2, until the desired digestion temperature and the desired digestion period has been reached.

6-Cold-displacement of the cooking liquor by means of washing filtrate from the pulp washing via the digester into tank CL2, until the digester contents have cooled to a desired temperature.

B.

7-Emptying the digester contents by pumping off and simultaneously adding washing filtrate to dilute the pulp to the desired consistency.

Process Steps Which are Continuous: (indicated by a framed "c")

1) Guiding of liquid between the respective tanks 2 and the associated tank 1.

2) Guiding of liquid between the respective tanks 1 and the associated tank 2, or only partially continuously, considering that the solvent throughput varies also depending on the process steps or may be interrupted, respectively.

3) Supplying wood chips into a bin located above the digester.

4) Discharging pulp from a discharge tank located downstream of the digester.

5) Supplying solvent concentrate from the processing, e.g. caustification.

6) Discharge of waste liquor to processing, e.g. vaporization plant.

7) Supplying medium pressure vapor.

8) Supplying low pressure vapor.

9) Discharging vapor condensate.

10) Supplying warm water.

11) Discharging hot water.

12) Suppling liquid (e.g. washing filtrate from the washing of pulp) into a tank (WF-tank), after which the digester contents are washed and cooled to a desired temperature.

What is claimed is:

1. A process for continuously guiding a liquid when digesting pulp in a digester, which comprises:

continuously (a) circulating one of an impregnation and a cooking liquid used in a process step in a first complete circulation circuit connecting a pair of tanks arranged at an inflow and outflow side of a pulp digester and (b) connecting the flow of the liquid from the first complete circulation circuit to the digester only when said process step has been reached.

2. A process according to claim 1, which comprises continuously discharging the liquid from the tank arranged at the outflow side of the digester; continuously adding doses of chemicals and subsequently continuously adjusting the temperature of the liquid by heat exchange, and recycling the liquid into the tank arranged at the inflow side of the digester.

3. A process according to claim 1 or 2, which comprises branching off a portion of the liquid at the outflow side of the digester, and continuously feeding the liquid into a second circulation circuit which is in flow communication between the tanks.

4. A process according to claim 3, which comprises replacing a portion of the volume of said one of the impregnation liquid and the cooling liquid by continuously feeding fresh chemicals and/or a washing solution and/or an additional liquid from a third circulation circuit.

5. A process according to claim 3, which comprises using the second circulation with a second process step which differs from the process step used with the first circulation circuit.

6. A process according to claim 1 which comprises continuously branching off a portion of the liquid at the outflow side of the circulation circuit between the tanks and continuously feeding into a chemical processing plant for recover of chemicals, and replacing the volume of the branched off portion of the liquid by adding a washing solution and/or an additional liquid from a second circulation circuit.

7. A process according to claim 1, which comprises determining at the outflow side of the digester a concentration profile of chemicals and increasing the concentration profile of the chemicals to maintain a predetermined concentration profile of the chemicals.

* * * * *